United States Patent [19]

Brovman

[11] Patent Number: 4,534,288

[45] Date of Patent: Aug. 13, 1985

[54] METHOD AND APPARATUS FOR REGISTERING OVERLAPPING PRINTED IMAGES

[75] Inventor: Yakov Z. Brovman, Mystic, Conn.

[73] Assignee: Harris Graphics Corporation, Melbourne, Fla.

[21] Appl. No.: 375,374

[22] Filed: May 6, 1982

[51] Int. Cl.[3] ..... B41F 5/06; B41F 5/16

[52] U.S. Cl. ..... 101/211; 101/181

[58] Field of Search ..... 101/181, 248, 211, 426; 250/548, 549, 566, 561, 571, 226; 356/429, 431

[56] References Cited

U.S. PATENT DOCUMENTS

| | | | |
|---|---|---|---|
| 2,339,204 | 1/1944 | Stockbarger et al. . | |
| 2,768,827 | 10/1956 | Noble | 101/181 X |
| 2,840,370 | 6/1958 | Noble | 101/181 X |
| 3,015,266 | 1/1962 | Anderson et al. . | |
| 3,033,109 | 5/1962 | Frommer | 101/181 |
| 3,701,464 | 10/1972 | Crum . | |
| 4,003,660 | 1/1977 | Christie et al. | 250/226 |
| 4,165,465 | 8/1979 | Kanatani et al. | 101/181 |

FOREIGN PATENT DOCUMENTS

| | | |
|---|---|---|
| 118467 | 2/1971 | Denmark . |
| 1041804 | 10/1953 | France . |
| 1053915 | 2/1954 | France . |

*Primary Examiner*—J. Reed Fisher

*Attorney, Agent, or Firm*—Yount & Tarolli

[57] ABSTRACT

Method and apparatus are disclosed for indicating and correcting misregister of plural overlapping images produced by a multicolor press. A register indicia (FIG. 3) is used comprising two overlapping sets of parallel lines (R and C), each set being formed in a known position relative to a corresponding one of the images whereby the positional relationship between the sets of lines varies with the positional relationship of the images. The extent of overlap of the sets of lines is dependent upon displacement of the sets of lines in a direction transverse to the lines, whereby the percentage of nonprint area in the register indicia is dependent upon register of the overlapping images in that transverse direction. The percentage of nonprint area is detected by illuminating the register indicia area and measuring the extent to which the area reflects the light. The resulting signal is used to control the register adjustment mechanisms of the multicolor press.

16 Claims, 20 Drawing Figures

METHOD AND APPARATUS FOR REGISTERING OVERLAPPING PRINTED IMAGES

BACKGROUND AND FIELD OF THE INVENTION

The present invention relates to register indicia and to control systems for adjusting the extent to which printed images overlap. More particularly, the invention relates to method and apparatus for detecting misregister and automatically registering two or more printed images.

In multi-colored printing, color images are produced by overprinting several images, each printed in different colors. To provide the proper effect, the several differently colored images should be aligned or "registered" quite precisely atop one another. To control this, the various printing units which together make up the multi-color press include adjustment mechanisms enabling one image to be moved relative to another. In order to set these adjustments properly, some technique must first be provided for detecting misregistration between the differently colored images.

The simplest method of detecting misregistration is for the pressman to visually study the printed product to identify the nature and extent of any misregistration between the images. This manual misregistration detection and adjustment technique allows great flexibility and permits the pressman to interject his own experience into the registration process. Manual registration adjustment is therefore widely practiced, either alone or in conjunction with automated systems.

Automated systems have some advantages over manual misregistration methods, principally in the speed with which they operate. Upon the initial start-up of a multi-color press some misregistration generally exists between the various printed color images. All of the printed product produced by the press until this misregistration is corrected is discarded as waste. It is therefore desirable to eliminate misregistration as rapidly as possible in order to reduce the extent of paper waste. Other factors requiring adjustment, notably color density, also contribute to paper waste.

Because of this, a variety of automated systems have been provided for detecting and correcting misregistration. Uniformly, these system require indicia separate and apart from the printed image, per se, in order to simplify the automated process of detecting misregistration. Most generally these indicia take the form of individual lines printed by the various units of the press concurrently with the images. The positional relationship between the register indicia lines is directly indicative of the registration between the corresponding printed images. Due to inconsistencies in the printing process, however, the register indicia lines have varying width and density, rendering accurate and repeatable automated determination of their position difficult.

Automatic measurement of the positional relationship between the two register indicia was inherently a dynamic process. One or more sensor was mounted on the press to detect the passage of the register indicia, and the time between passage of the first and second register indiciums was equated with physical displacement between the two indicia. The measurement was therefore press-speed dependent.

Independently of registration control, color bars have been used in the past for ink density control and press operation diagnostics. The color bars have been printed on the web concurrently with the printing of the image, usually in the margins between the images on the web. No unified system has been used, however, for dealing with both color and registration control; the two have historically been treated as separate problems with separate printed indicators and separate control processes.

BRIEF SUMMARY OF THE INVENTION

It is a general object of the present invention to provide a unified system for measuring and treating registration errors and color errors.

It is another object of the present invention to provide a register error measurement process which is static in nature, in that it does not rely upon movement between a sensor and the register indicator in order to detect and quantify register error.

It is another object of the present invention to provide method and apparatus for detecting misregister between two overlapped images produced, for example, in a multicolor printing operation.

It is also an object of the present invention to provide an automated registration detection system which provides accurate and repeatable misregistration detection.

It is still another object of the present invention to provide misregistration detection method and apparatus employing novel register indicia.

It is yet another object of the present invention to provide method and apparatus for detecting and correcting misregister employing a register indicia wherein the percentage of print area in a register indicia area is sensed and used as an indication of the accuracy of register of two overlapped images.

In accordance with one aspect of the present invention a method is provided of detecting misregistration between two overlapped images. The method comprises the steps of forming a first plurality of tranversely spaced, substantially parallel lines in a first indicia area occupying a known position relative to one of the overlapped images, and forming a second plurality of transversely spaced, substantially parallel lines in a second indicia area occupying a known position relative to the other of said overlapped images. The second plurality of lines are oriented substantially parallel to the first plurality of lines such that when the first and second areas overlap one another the extent to which the lines overlap one another in the region in which the indicia areas overlap changes with transverse displacement between the two indicia areas. The known position of the second indicia area is selected so that when the first and second overlapping images are in register, the first and second indicia areas overlap.

DESCRIPTION OF THE DRAWINGS

The foregoing and other objects and advantages of the present invention will become more readily apparent from the following detailed description, as taken in conjunction with the accompanying drawings, wherein.

DETAILED DESCRIPTION

Figure 1:
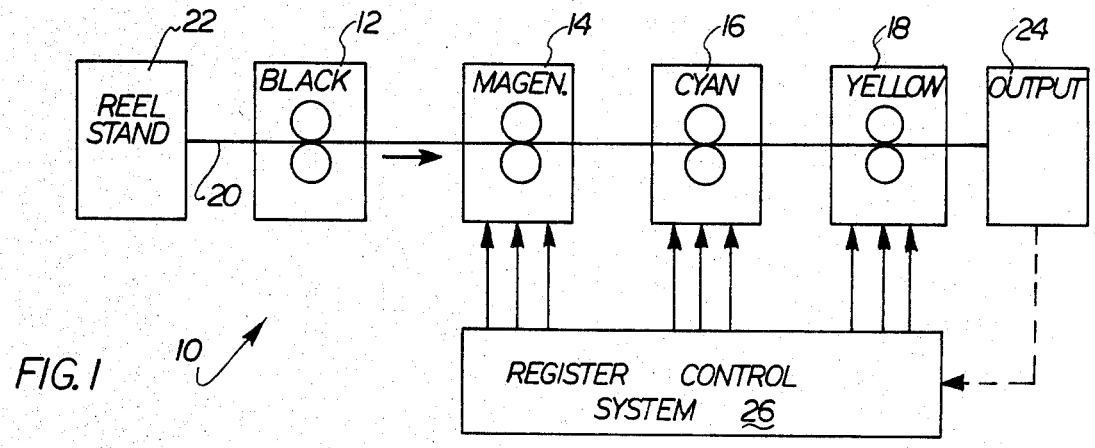
FIG. 1 is a block diagram of a conventional four color press.

FIG. 1 is a schematic representation of a conventional four color printing press 10. The press 10 includes plural printing units 12, 14, 16 and 18 for printing on a moving web 20 which unwinds from a reel stand 22. As the web 20 moves through each of the printing nips associated with the printing unit 12–18, it receives a printed image having a color corresponding to the color of the ink laid down by that printing unit. The images printed by the various printing units 12, 14, 16 and 18 overlap one another so as to provide a color image. Upon exiting the last printing unit 18, the web enters the output portion of the printing press, including ink driers as well as slicer, folder and trimmer units. The product provided by the output portion 20 comprises individual printed signatures containing color images.

The fidelity of the color images produced by the press is dependent in large part on the extent to which the single color images laid down by the various printing units 12–18 are aligned over one another. To control this a register control system 26 is included. Register control system 26 provides control signals to the three color printing units 14, 16 and 18 for controlling the locations upon the web at which their respective printed images are laid down. More particularly, the register control system 26 provides control signals for controlling lateral registration, circumferential registration, and cylinder cocking.

Figure 2:
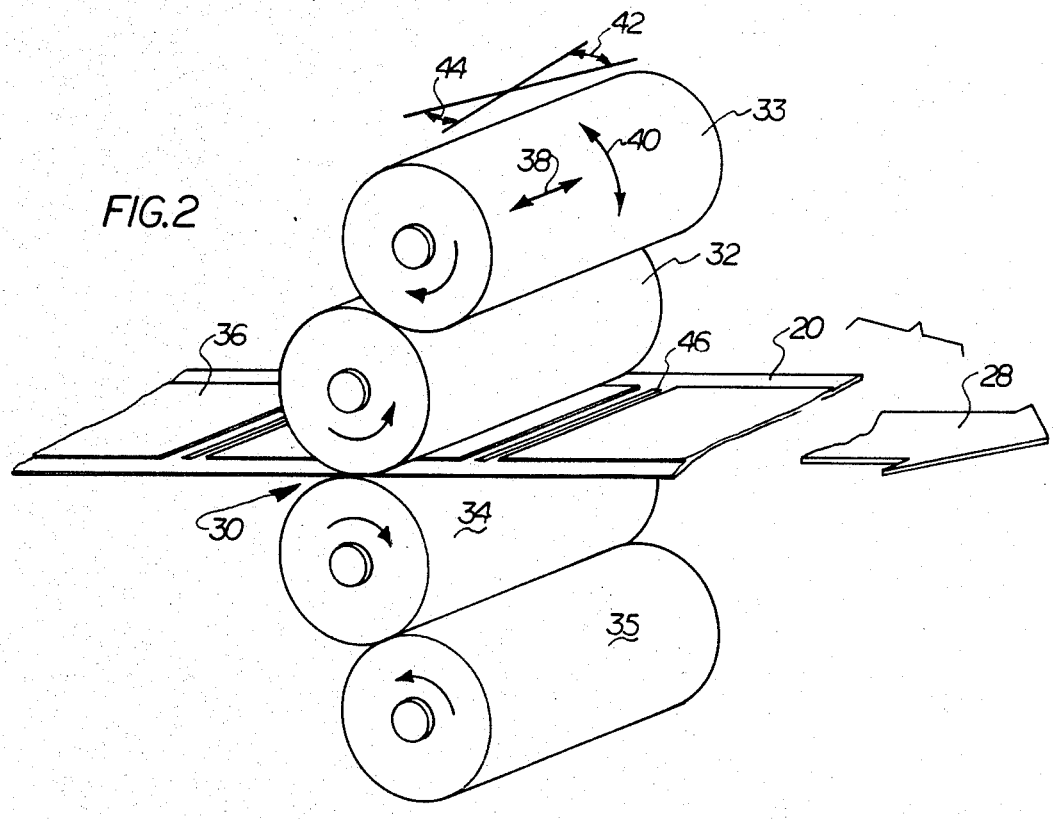
FIG. 2 is a prespective illustration of a web passing through a printing nip, and is useful in understanding the type of adjustments to be made in correcting misregistration.

The nature of the printing unit adjustments controlled by these signals can best be seen in FIG. 2, which is a simplified representation of an offset, perfecting printing unit. In this Figure, the web 20 is shown as moving in the direction indicated by the arrow 28 through a printing nip 30 formed by rolling contact between two blanket cylinders 32 and 34. The blanket cylinders receive ink images from respective plate cylinders 33 and 35, upon which are mounted the printing plates (not shown).

Before entering the printing nip 30, the web 20 already has black images 36 formed thereon due to the operation of printing unit 12. The images printed upon the web 20 by the blanket cylinder 32 should be in precise registry with the images 36. To adjust the location of the printed image formed by the blanket cylinder 32 the printing unit includes mechanisms for moving the plate cylinder 33 relative to the blanket cylinder 32. These mechanisms are entirely conventional and will not be shown or described herein for that reason.

One mechanism is controllable to move the plate cylinder 33 in a direction transverse to the movement of the web 20, as indicated by the arrow 38. By controlling the operation of this mechanism the lateral registration of the images may be controlled. Another mechanism is controllable to cause a phase shift of the plate cylinder 33 relative to the web so as to thereby slightly adjust the longitudinal position of the image placed on the web 20 by the blanket cylinder 32. The motions effecting circumferential register are indicated by the arrow 40. A third mechanism is controllable to cock the plate cylinder 33 relative to the blanket cylinder 32, thereby controllably skewing the images placed upon the blanket cylinder 32 by the plate cylinder. The direction of this cylinder cocking is indicated by the arrows 42 and 44. All three of these mechanisms are controlled by the register control system 26.

Similar mechanisms are provided for controlling the plate cylinder 35. These mechanisms, also, are controlled by the register control system 26. In the interest of simplicity, however, the following discussion will relate only to the adjustment of the upper plate cylinders of each unit. The lower plate cylinders are adjusted in similar manner.

The register control system 26 determines the extent of misregistration in lateral, and circumferential directions in order to determine the extent to which lateral and circumferential registration and skew are to be adjusted. In accordance with the present invention the register control system 26 determines the extent of lateral and circumferential misregistration, as well as skew, as part of a unified press control process. The system derives not only color and diagnostic information but also register information from color bars 46 which are printed concurrently with the printing of the images on the web 20. The color bar 46 is comprised of 136 square "fields" arranged along a line extending transversely between the two edges of the web 20 in an area normally trimmed or otherwise removed from the finished product. The color bar could instead be formed elsewhere, of course, such as along the edges of the web. This is not presently preferred, however, since in this event the color bar would not contain color information relating to the ink fountains near the center of the web. Each field of the color bar is, for example, approximately $\frac{1}{4}''$ square. In accordance with the present invention a number of these fields are formed such that register and skew information can be detected during scanning of the color bar in a fashion to be described hereinafter. The register fields have plural parallel lines formed therein so as to serve as register indicia.

Figure 3:
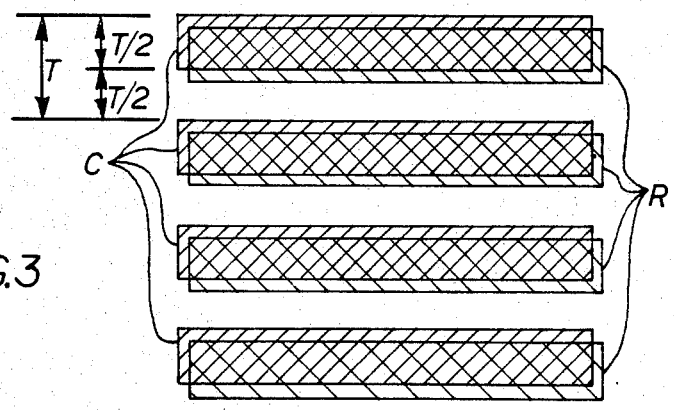
FIG. 3 is an illustration of a register indicia in accordance with one aspect of the present invention.

In the preferred embodiment, each register indicia field I, as shown in FIG. 3 includes two overlapping sets of lines, one set R printed in a reference color (usually black) and the other set C printed in a color (referred to herein as a "comparison" color) whose image position is to be adjusted so as to achieve register with the black image. Each set of lines includes plural linear, parallel lines disposed beside one another across the field. The reference color lines are preferably of equal width T/2 and are spaced apart by the same distance T/2. The lines therefore have a "period" T. The comparison color lines preferably have the same width and spacing as the reference color (black) lines.

The two sets of lines are printed so that the lines of one are essentially parallel to the lines of the other. When formed thus the percentage of nonprint area in the register indicia field varies with register error in a direction perpendicular to the lines. More particularly, when the two sets of lines are aligned so that each comparison color line is in register over a reference color line, essentially 50% (i.e., the area between the lines) of the field will be nonprint area. When the comparison color is transversely displaced from this alignment by an amount corresponding to the thickness of the lines, however, essentially 0% of the field will be nonprint area since the two sets of lines will be completely interlaced, leaving no unprinted space. Between these two extremes the percentage of nonprint area varies linearly with displacement.

The percentage of nonprint area in the register indicia field can therefore be used as a measure of the relative positions of the reference and comparison colors in a predetermined direction, i.e., perpendicular to the lines in the register indicia field. Moreover, the sensitivity of this register indicator to relative positional changes can be selected by selecting the period T of the lines used. If a large number of thin lines are used (i.e., small T), the indicia is quite sensitive since only a small positional change is then required to move the sets of lines from alignment to full interlace. If relatively few, thick lines are used, however (i.e., large T), the same positional changes will have less impact on the alignment of the two sets of lines.

Although the register indicia field of FIG. 3 is very useful in detecting changes in register error, it is difficult to determine actual magnitude and direction of register error therefrom since there is no standard against which to compare the percentage of nonprint area in the field. Consequently, in a preferred embodiment of the present invention two different register indicia fields are employed. The actual amount of register error is then determined by comparing the two fields. The register error measurement process will be described further hereinafter with reference to FIG. 6. A presently preferred form of the two indicia fields will first be described with reference to FIGS. 4A, 4B and 4C, however.

Figure 4B:
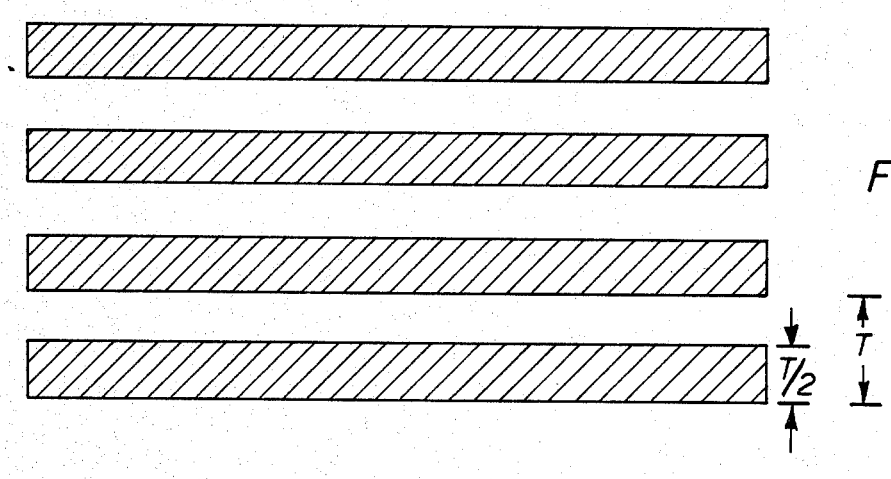
FIGS. 4A–4C and 5A–5C are illustrations of preferred forms of printing register indicia, each using two indicia fields.
Figure 4C:
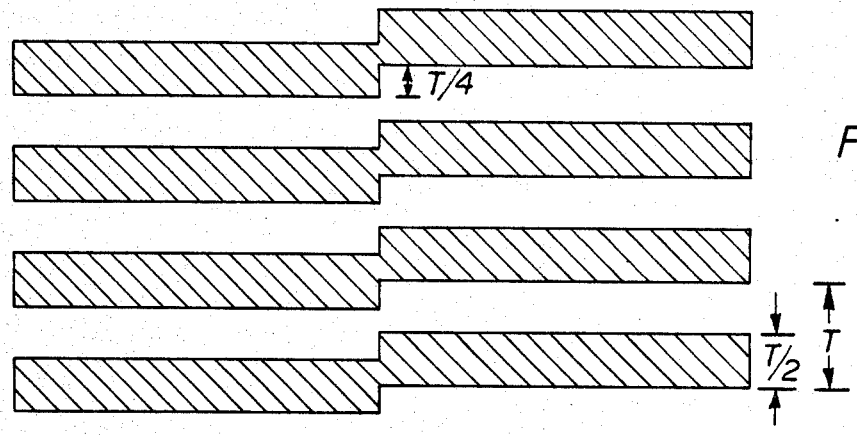
Figure 4A:
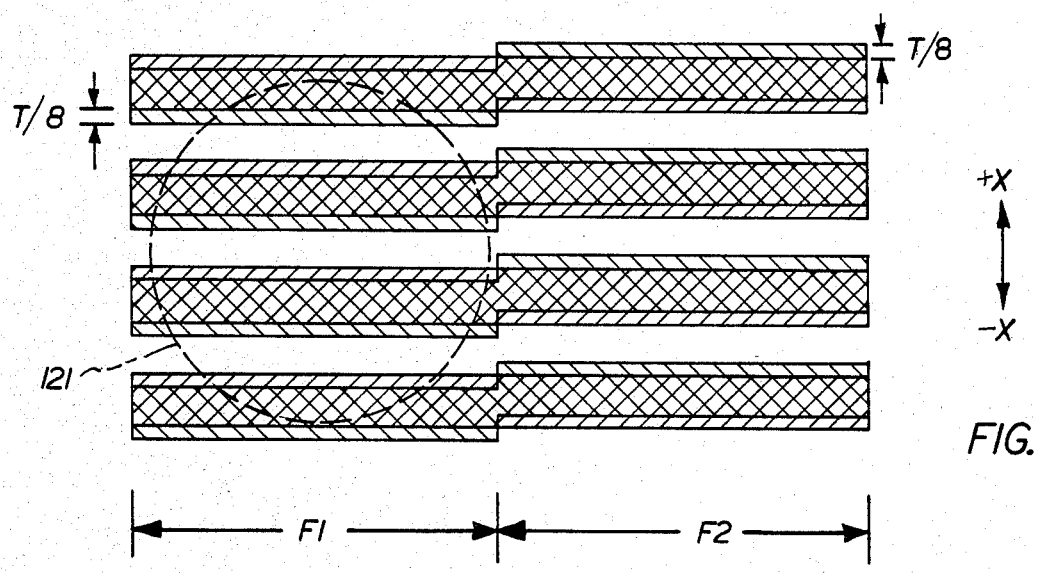

In FIG. 4A two exemplary register indicia fields F1 and F2 of the color bar, are shown. FIGS. 4B and 4C show the reference and comparison color components separately. As can be seen in FIG. 4B, wherein the shaded portion indicates the portion which is printed in the reference color, the same set of lines is produced in both fields in the reference color. In each of the fields F1 and F2 the indicator includes plural lines, each extending the entire width of the field, and having a line width which is substantially equal to the spacing between the lines. The areas between the plural lines are unprinted.

As can be seen in FIG. 4C, wherein the shaded portion indicates the area to be printed in the comparison color, the images printed in the two fields F1 and F2 are similar to each other but are transversely offset by T/4. Each consists of plural lines extending across the widths of the respective fields, with the lines having the same spacing and width as the reference color lines of FIG. 4B. The comparison color lines in field F2 are transversely displaced by T/4 with respect to the comparison color lines in field F1. When the reference and comparison colors are in proper register, the plural lines in field F1 are displaced slightly downward with respect to the reference color lines, whereas the comparison color lines in field F2 are displaced slightly upward with respect to the reference lines. The two fields F1 and F2 then appear as shown in FIG. 4A.

As seen in FIG. 4A, perfect registration between the two colors results in the extent of overlap of the colors in the first field (F1) being equal to the extent of overlap of the two images in the second field (F2). In field F1 the plural lines of the comparison color protrude below the corresponding lines in the reference color by an amount corresponding to one quarter of the thickness of the lines (i.e., to T/8), whereas in the second field F2 the plural lines of the comparison color rise above the corresponding lines in the reference color by the same amount.

Figure 5:
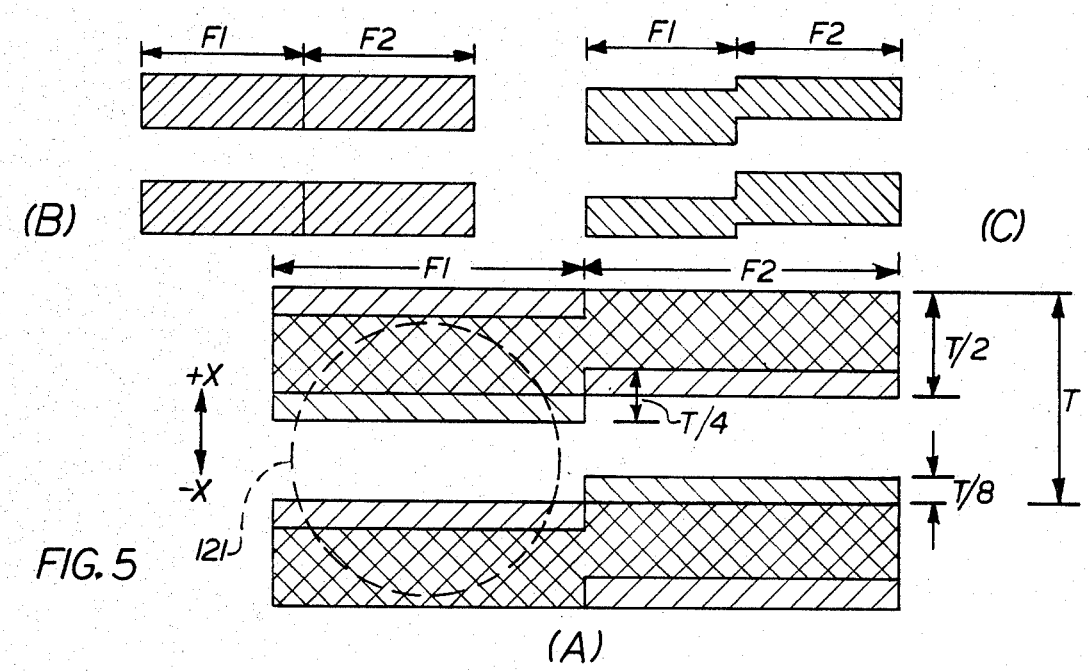

The period T of the lines is rather large in the FIG. 4 example. Of course, the period T of the lines may be selected to provide any desired indicia sensitivity. When a smaller period T is employed, a larger number of lines will be present in the fields. When a larger period T is employed, a smaller number of lines will be present in the fields. FIGS. 5A, B and C correspond with FIGS. 4A, B, and C but represent a situation where a larger T is selected such that fewer reference and comparison color lines are present in each field.

Register error in a direction perpendicular to the direction of extension of the comparison color and reference color lines can be calculated in accordance with the percentage of nonprint areas in the two fields F1 and F2. From FIG. 4A it is apparent that the percentage of nonprint area of the two fields F1 and F2 is equal when the two images are in register. When the comparison image is displaced upward (from the position shown in FIG. 4) by an amount less than T/8 with respect to the reference color, the percentage of nonprint area in field F1 will increase whereas that in field F2 will decrease. The percentage of nonprint area in field F1 will then be greater than the percentage of nonprint area in field F2. When, on the other hand, the comparison color is displaced downward (from the position shown in FIG. 4) by an amount less than T/8 with respect to the reference color, the percentage of nonprint area in field F1 will diminish, whereas that in field F2 will increase. The percentage of nonprint area in field F2 will then be greater than the percentage of nonprint area in field F1.

Figure 6:
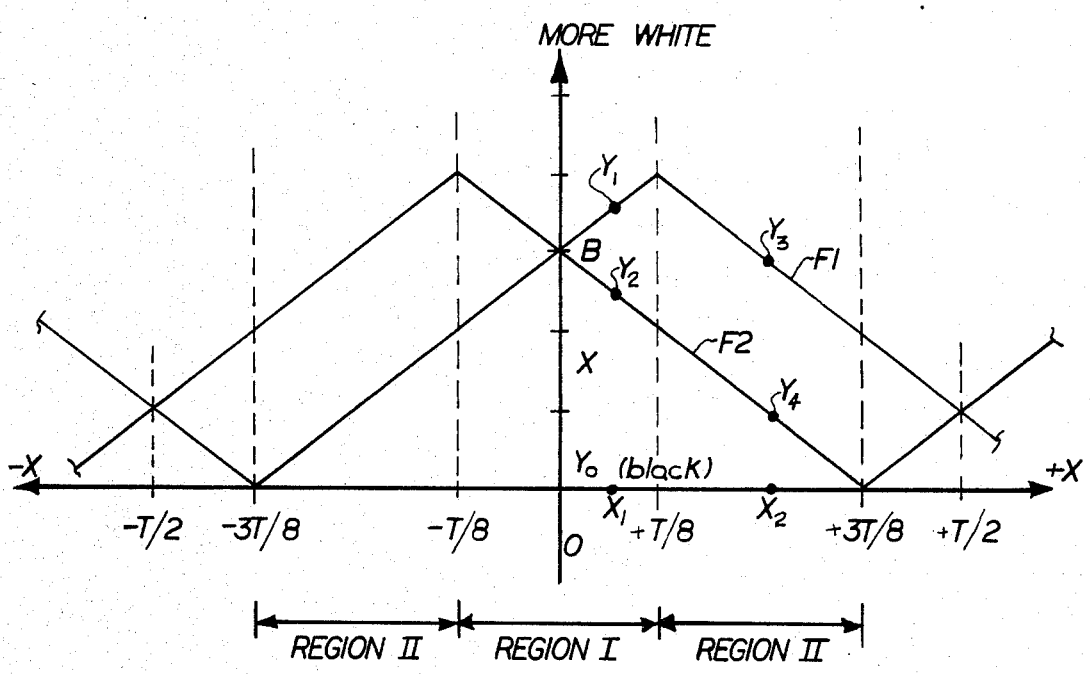
FIG. 6 is a graph indicating the manner in which the printed area of the two register indicia fields shown in FIG. 4 change with register error.

The relationship between misregister and the percentage of nonprint area in the two fields is shown graphically in FIG. 6, where the curve F1 indicates the percentage of nonprint area in field F1, and the curve F2 represents the percentage of nonprint area in field F2. The fields F1 and F2 achieve maximum percentage of nonprint area at misregisters of +T/8 and −T/8, respectively. At these displacements the sets of lines in the comparison color in one field are aligned with the sets of lines in the reference color. The percentage of nonprint area decreases linearly from these peaks until reaching a value of 0 at displacements wherein the lines in the comparison color completely block the nonprint area in the reference color (i.e., the sets of lines are interlaced). This occurs at a displacement of plus and minus 3T/8 for the fields F2 and F1, respectively.

The magnitude and direction of register error can be directly calculated in accordance with the percentage of nonprint area in each of the two fields F1 and F2. If we presume that the reference color and the comparison color are misregistered by an amount $X_1$, then the percentage of nonprint areas in the fields F1 and F2 will be $Y_1$ and $Y_2$, respectively. But:

$$F1=B+AX \quad (1)$$

$$F2=B-AX \quad (2)$$

where

B is the Y axis intercept value of both functions, i.e., the percentage of nonprint area in each field when the register error X is equal to zero, and A is the slope of the linear portion of function F1 in the region between X=0 and X=+T/8, and the negative of the slope of F2 in the same region.

But since $F1(X_1)=Y_1$ and $F2(X_1)=Y_2$, then:

$$Y_1=B+AX_1 \quad (3)$$

$$Y_2=B-AX_1 \quad (4)$$

Both of these equations are dependent upon unknown constants B and A, hence the register error $X_1$ may not be readily calculated from either, by itself. For this reason it is difficult to calculate absolute register error based solely upon the percentage of nonprint area in a single register indicia field. The Y axis intercept value B can be shown to be equal to 3AT/8, where A is again the slope and T is the period of the lines in fields F1 and F2. When this is substituted into equations (3) and (4) the unknown term "B" can be eliminated. The unknown "A", however, is still present. By manipulating these two equations, however, we find that:

$$X_1 = \frac{(Y_1 - Y_2)}{(Y_1 + Y_2)} \frac{3T}{8} \quad (5)$$

The unknowns A and B do not appear in this equation. The register error X is instead expressed solely in terms of the known variables $Y_1$ and $Y_2$ and the known constant T. Furthermore, the result of the equation will be the same even if the "percentage of nonprint area" terms $Y_1$ and $Y_2$ are multiplied by the same gain constant, as might occur during the process of determining the values of these terms. This is because such arbitrary gain constants will appear in both the numerator and denominator of equation (5), and will therefore cancel.

The foregoing equations hold true, however, only for misregistration errors in the range of ±T/8. Outside of this region (region I) the slope of one or the other of the lines changes, hence equations (1) and (2) no longer apply. In the region (region II) between registration errors of +T/8 and +3T/8, the equations for functions F1 and F2 are:

$$F1 = \frac{5AT}{8} - AX \quad (6)$$

$$F2 = \frac{3AT}{8} - AX \quad (7)$$

Equation (7) is the same as equation (4), except that the Y axis intercept value B is expressed in terms of the slope A and line period T.

If we presume that $F1(X_2)=Y_3$ and $F2(X_2)=Y_4$, then:

$$Y_3 = \frac{5AT}{8} - AX_2 \quad (8)$$

$$Y_4 = \frac{3AT}{8} - AX_2 \quad (9)$$

These equations may again be manipulated to derive a result which is independent of the slope A and which is similarly independent of arbitrary gain constants. Thus, by manipulating equations (8) and (9) we get:

$$X_2 = \frac{T}{2} - \frac{(Y_3 + Y_4)}{(Y_3 - Y_4)} \frac{T}{8} \quad (10)$$

This same equation is also applicable to registration errors in the range −T/8 to −3T/8.

Equations (5) and (10) permit identification of the actual registration error X in dependence solely upon the percentage of nonprint areas in the two fields F1 and F2 and the known period T of the lines. The percentage of nonprint area in a given field can be readily determined by measuring the amount of light reflected from the field. This process will be described hereinafter.

Since the two equations (5) and (10) provide different X values for the same Y values, it is necessary to determine which of the two equations to apply for any given pair of Y values. This can be determined by utilizing the measured Y values to calculate an X value from equation (5). If the X value thus determined has an absolute magnitude less than T/8, then the X value is accurate. If the absolute value of the X value is above T/8, however, then the value thus determined is inaccurate and a recalculation must be done with equation (10).

Using the relations of equations (5) and (10), register errors in the range of +3T/8 to −3T/8 can be quantified. If T is large, the range is similarly large and thus gross register errors can be calculated. If T is small, however, small register errors can be calculated with greater precision. For this reason, it is presently preferred that two pairs of fields having different T values be used. Each pair of fields is referred to hereinafter as one "digit" of register indicator. One digit has a large T value and is used for coarse register control. The other digit has a small T value and is used for fine register control.

In accordance with the present invention, the registration indicia are utilized to detect lateral and circumferential misregister, as well as cocking, in a multicolor press simultaneously with detecting color variations and diagnosing press conditions. This is possible because the register indicator which has been described can readily be formed as part of a color bar. Register error detection and measurement can therefore be accomplished during the scanning of the color bar. (The register indicia described could, however, be formed elsewhere on the web, including within the printed image.) To accomplish this, the color bar 46 (FIG. 2) is designed to include plural register indicia of the type described above with respect to FIG. 5. The color bar is shown in greater detail in FIGS. 7A and 7B. As described previously, the color bar 46 includes 136 square fields disposed adjacent one another in a line extending transversely between the two edges of the web.

The 136 fields are grouped into nine register bands, two diagnostic bands, and twelve color bands. The color bands alternate with the eleven register and diagnostic bands across the color bar. Each color band includes four fields, each field being printed in a different solid color (i.e., without screens or lines). The register bands, on the other hand, include eight fields, four of which are devoted to two digits of registration indicia, and four of which contain lines and screens in the color to which the registration indicia for that band relate (i.e., in the comparison color).

Figure 7A:
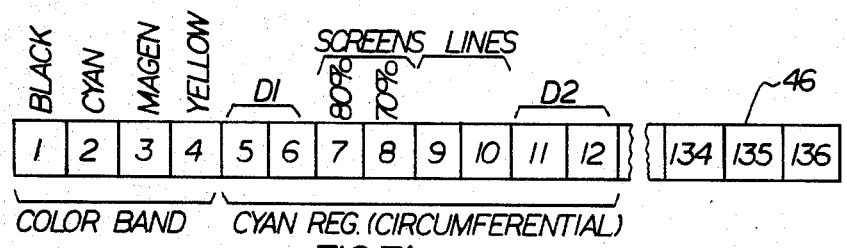
FIGS. 7A and 7B are illustrations of a color bar incorporting the register indicia of FIG. 5 in plural fields thereof for detecting circumferential and lateral registration error and cylinder cocking.

FIG. 7A shows the contents of the first 12 fields of the color bar. The first four fields of the color bar are solid black, cyan, magenta, and yellow, respectively. These four fields represent one color band. Fields 5 and 6 represent one "digit" of the register indicator for registering the cyan color in a circumferential direction. These two fields may, for example, be identical to the fields shown in FIG. 5, and have a line thickness of one-tenth of an inch such that T=0.2". This register digit is used for coarse register control. Fields 7 and 8 are 80% and 20% screens in the cyan color, whereas fields 9 and 10 are different thickness lines in the cyan color. Fields 11 and 12, which are the last fields in this register band represent the second "digit" of registration indicator. In this second digit the period T of the lines used is substantially reduced (e.g. equal to one-hundredth of an inch such that T=0.02") so that the indicator is much more sensitive to small register errors than is the first digit. The second digit is used for fine register control. The reference and comparison sets of lines in the two fields of the second digit are again displaced from one another by +T/8 and −T/8, as described with reference to FIG. 4.

Figure 7B:
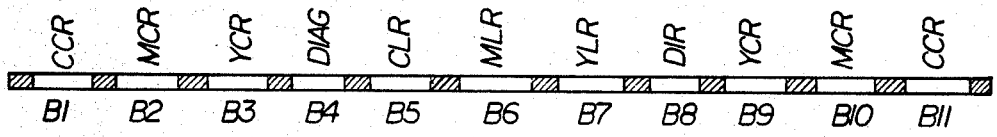

FIG. 7B illustrates schematically the arrangement of the 11 register and diagnostic bands and the 12 color bands which separate them. In this Figure the cross-hatched portions each represent a color band similar to the first four fields of the color bar. The register bands, on the other hand, each includes eight fields arranged similar to the cyan circumferential register band illustrated in FIG. 7A (i.e., fields 5–12). The nine register bands are indicated in FIG. 7B as B1–B3, B5–B7, and B9–B11. The comparison color used in each register band corresponds to the color to be registered, and the orientation of the lines is perpendicular to the direction in which register is being detected. The bands B4 and B8 are diagnostic bands whose fields include colors representing mixtures of the pure colors which are laid down by the various printing units.

The first three register bands and last three register bands (B1–B3 and B9–B11) are used for detecting circumferential register error and cylinder cocking. In bands B1 and B11 the comparison color is cyan. In bands B2 and B10 the comparison color is magenta and in bands B3 and B9 the comparison color is yellow. In all six of these fields the orientation of the lines in both digits of the registration indicia is parallel to the orientation of the color bars (i.e., transverse to the web), whereby register error is detected in a circumferential direction, as indicated by the arrow 40 in FIG. 2. Bands B5, B6 and B7, which are the center three bands of the color bar, are used for detecting register error in a direction transverse to the web, and therefore are referred to as lateral register bands. In these bands the indicia fields are each rotated 90° so that the lines in the various register indicia digits are oriented in a direction perpendicular to that shown in FIG. 7, and thus run parallel to the edges of the web. In register band B5 the comparison color is cyan, whereas in bands B6 and B7 the comparison colors are magenta and yellow, respectively.

Generally stated, the color bar is scanned by sequentially illuminating each field with electromagnetic energy (usually light, either visible, infrared or ultraviolet) and measuring the amount of energy reflected from the field. The frequency of electromagnetic energy to be used is selected such that the energy is absorbed by the ink which forms the indicia and reflected by the background. The selection of the appropriate frequency range may be made by using a source which radiates only at those frequencies, a detector which is sensitive to only those frequencies, or by placing appropriate filters at some point in the path of the energy. If the field is entirely covered by the indicia, very little of the electromagnetic energy is reflected. If, however, the field is entirely free of printed indicia, the background is completely exposed and a relatively great amount of the energy is reflected. The measure of reflected energy is therefore indicative of the extent to which the indicia covers the background on that field. In the example being described, the background is unprinted. Consequently, the measure of reflected energy is also a measure of the percentage of nonprint area in the field.

It will be noted that the process for reading each field of the color bar is essentially static in nature; the amount of reflected energy is measured at a given instant in time, rather than over a finite period while the indicia moves relative to the sensor. Furthermore, the value obtained is representative of a characteristic of the entire area, rather than a distance or dimension measurement of details within the field.

An automated system is used to scan the color bar. One method of accomplishing this, which will be described later herein, is to sense the percentage of nonprint areas in the various digits of the registration bands at some point on the press, while the web is still intact. A second is to scan the color bars only after the web has been sectioned into signatures and the signatures delivered at the output of the press. In this second method, the signatures are carried to a scan table where they are aligned underneath a scanning device for scanning the various registration bands either simultaneously or sequentially. One mechanism for implementing this second method is illustrated and will be described hereinafter with respect to FIGS. 8–10.

Figure 8:
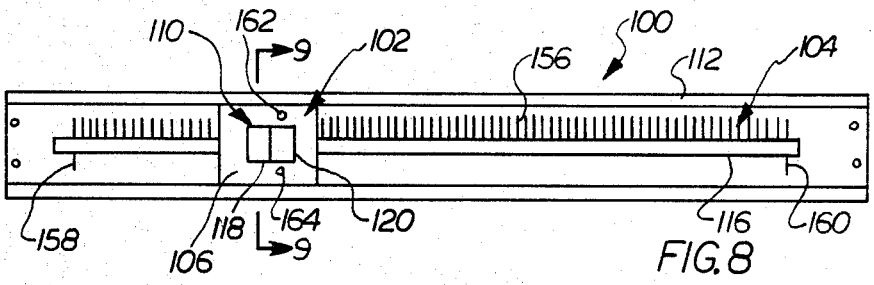
FIG. 8 is a plan view of a scanner assembly for scanning the color bar of FIG. 7.
Figure 9:
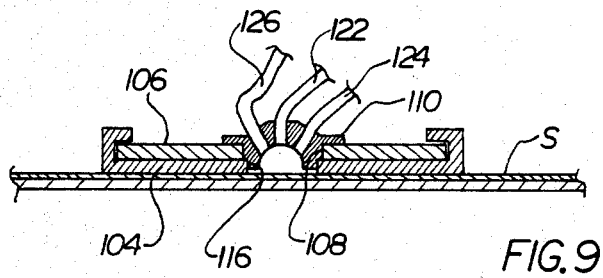
FIG. 9 is a sectional view of the scanner assembly of FIG. 7 taken along line 9—9 of FIG. 8.
Figure 10:
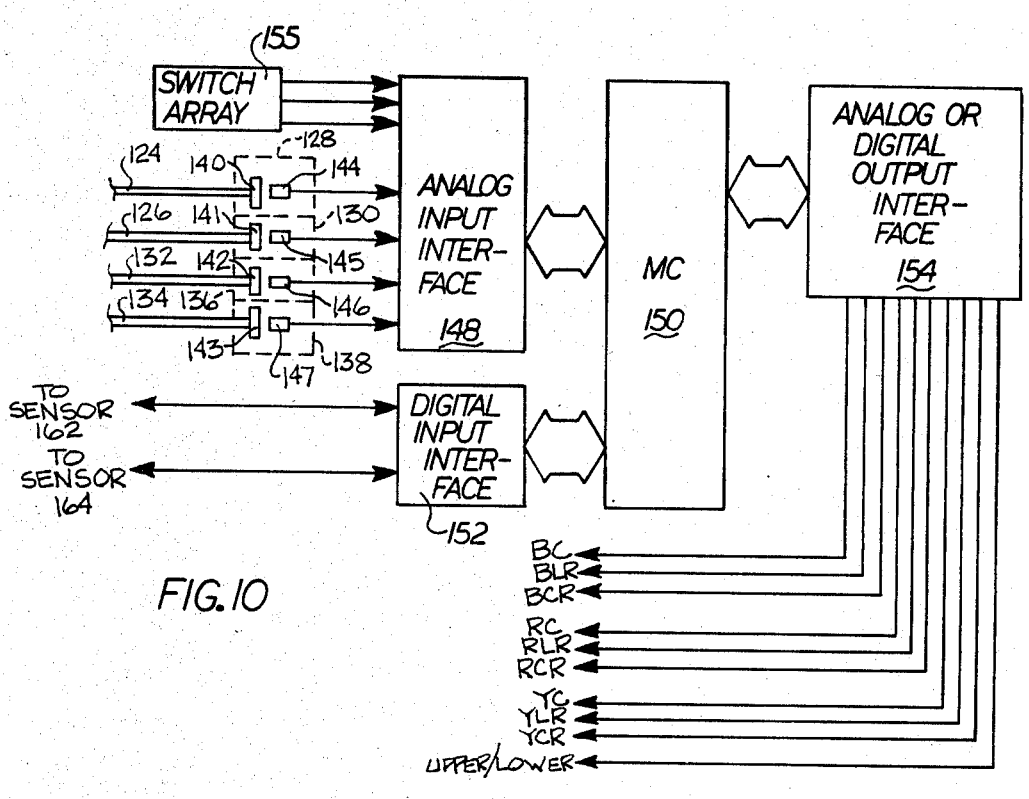
FIG. 10 is a broad block diagram of the microcomputer circuitry which responds to the signals provided by the scanner assembly of FIGS. 8 and 9.

FIG. 8 is a plan view of a scanning mechanism, whereas FIG. 9 is a sectional view taken along line 9—9 of FIG. 8. In these Figures, the scanning mechanism 100 is shown as including a scanning assembly 102 and a guide channel 104. The scanning assembly 102 includes a rectangular base plate 106 having a window 108 formed therein, and a scanning head 110 disposed over the window. The scanning head includes plural connections for fiber optic cables which both illuminate and observe the color bar through the window 108. The guide channel 104 is a planar bar having a width which is similar to the width of the base plate 106 of the scanning assembly 102. The scanning assembly 102 rests atop the guide channel 104 and slides back and forth in a longitudinal direction over the guide channel. The guide channel 104 has opposed lateral edges 112 and 114 which are curled upwardly and inwardly so as to confine the opposing edges of the base plate 106 of the scanning assembly 102.

The guide channel 104 also includes a centrally disposed elongated window 116 which extends most of the length of the bar and is formed generally in lateral register with the window 108 of the base plate 106. The window 116 is sized such that a signature bearing a color bar as shown in FIG. 7B may be located beneath the guide channel 104 in alignment with the window 116, whereby the scanning assembly 102 may be manually moved back and forth over the opening to thereby scan each and every field of the color bar. The scanning head 110 protrudes beneath the lower surface of the base plate 106 into the window 116 of the guide channel 104. The scanning head 110 protrudes far enough into window 116 that its bottom surface is nearly flush with the lower surface of the guide channel 104.

The scanning head 110 includes two optical assemblies mounted side by side over the window 108 in the base plate 106. Each optical assembly 118 and 120 of the scanning head 110 has a hemispherical chamber formed therein which opens onto the window 116, but which is otherwise sealed from external light. The chambers in the two optical assemblies 118 and 120 are sealed from one another, as well. Each optical assembly 118 and 120 further includes three tapped openings therein for the connection of respective fiber optic cables such that the cables are in optical communication with the corresponding chamber of the optical assembly.

When affixed to the respective optical assembly of the scanning head 110, each fiber optic cable is directed toward the center of the window 116 whereby it views the various fields of the color bar positioned underneath the guide channel 104 as the scanning assembly 102 is moved back and forth thereover.

More particularly, the fields of view of all three optical fibers coincide with the circular area delineated by the dotted line 121 in FIG. 4A. In the embodiment being described, the center optical fiber 122 of optical assembly 118 is attached to a light source (not shown), whereby the field located within the field of view of that portion of the scanner assembly is illuminated thereby. The remaining two optical fibers 124 and 126 are attached to photosensitive detector assemblies 128 and 130 (FIG. 10), respectively. Similarly, the center optical fiber of the second optical assembly 120 of the scanner head is connected to an optical source, and the other two optical fibers 132 and 134 of that assembly are connected to associated detector assemblies 136 and 138. The fiber optic cables have been omitted from FIG. 8 to simplify the drawing.

The four detector assemblies are all similar, each including a corresponding filter 140–143 and photosensitive element 144–147. The four filters 140–143 are the compliments of the four colors printed by the multi-colored press. Since the four proper colors printed by the press are magenta, cyan, yellow and black, the four filters are green, red, blue and yellow. When a registration indicia such as that shown in FIG. 4A is viewed through a filter which is the compliment of the comparison color, both of the sets of lines appear to be black. Consequently, the amount of reflected light can be used as an indication of the percentage of nonprint area within the field of view of the filter.

To take readings of the amount of reflected light from each field as viewed through each of the complimentary filters, the scanning assembly 102 is moved by hand from one extreme end of the window 116 to the other. As the scanning assembly 102 moves along the window the outputs of the four detector elements 144–147 are periodically sampled by a microcomputer (FIG. 10), with the resulting sampled values representing the "Y" values referred to previously with respect to FIG. 6.

In the embodiment currently being described the outputs of the four photosensitive elements 144–147 are connected to respective input lines of an analog input interface 148. The interface 148 includes circuitry for sampling the analog signals provided by each of the photosensitive elements, under control of the microcomputer 150. The sampled analog levels are converted to corresponding digital signals by an analog-to-digital convertor included within the interface. The resulting digital signals are provided to the microcomputer for use in determination of register error. The analog input interface 148 and microcomputer 150 are two elements of a conventional measurement and control processor such as the Hewlett Packard HP2250. Other elements of the measurement and control processor include a digital input interface 152 and an analog or digital output interface 154. Since these elements are entirely conventional and are readily available, they will not be described in detail herein.

In the present embodiment, the microcomputer 150 is triggered to sample the outputs of the optical detectors 144–147 by trigger signals generated from timing marks 156 aligned adjacent the window 116 in the guide channel 104. The timing marks 156 are inscribed on the guide channel such that, when a color bar is properly aligned within the window 116, the timing marks are aligned above the centers of corresponding fields of the color bar.

Two other marks, referred to as start and stop marks, are inscribed below the window 116. These marks define the first and last fields in the color bar, and are used to initiate and conclude a scan of the color bar. Conventional indicia sensors 162 and 164 are mounted on the base plate 106 of the scanning assembly 102 in order to detect the passage of the timing marks 156, 158 and 160. The sensors may, for example, be similar to those used to sense the bar codes now provided on most consumer products.

The sensors 162 and 164 are located in transverse alignment with the second optical assembly 120 of the scanning head 110. Consequently, each time one of the timing marks 156 is detected by the timing mark sensor 162, the second optical assembly 120 is aligned above a corresponding one of the fields of the color bar. The field of view of the first optical assembly 118 of scanning head 110 is displaced from the field of view of second optical assembly 120 by a distance corresponding to the width of four fields. Consequently, the second optical assembly 120 is located in optical alignment with one of the fields each time the first optical assembly 118 is located in optical alignment with one of the fields. Since it is desirable to have each of the assemblies 118 and 120 scan each of the fields of the color bar, the scanner assembly 102 is moved over a total number fields which is four greater than the actual number of fields in the color bar. Consequently, there are 140 of the timing marks 156, four more than the total number of fields. This insures that each optical assembly views each field of the color bar, even though the two assemblies are displaced from one another.

In operation, a signature S printed by the press is taken from the press output and aligned under the guide channel 104 such that the color bar is in registration with the window 116 therein. More particularly, the color bar is aligned within the window 116 such that each of the timing marks 156 is aligned over a center of a corresponding one of the fields, with the start mark 158 being aligned beneath the center of the first field in the color bar. In this position the last field of the color bar is displaced rightward (as viewed in FIG. 8) by four fields with respect to the start mark 158.

After having been thus positioned, the guide channel 104 is clamped in its position over the signature S by clamping elements not shown in the Figures. The scanner assembly 102 is then moved to the far left of the window 116, whereby the timing sensors 162 and 164 are located leftward (again as viewed in FIG. 8) of the start mark 158 and the leftward most one of the field timing marks 156. The operator sets one of the switches of the switch array 155 to a position indicating whether the color bar to be scanned is from the top or bottom of the web. The operator then depresses another of the switches of the switch array 155 to initiate the acquisition of data. The operator thereafter moves the scanner assembly 102 along the window 116 until it reaches the extreme right end of the window.

Figure 11:
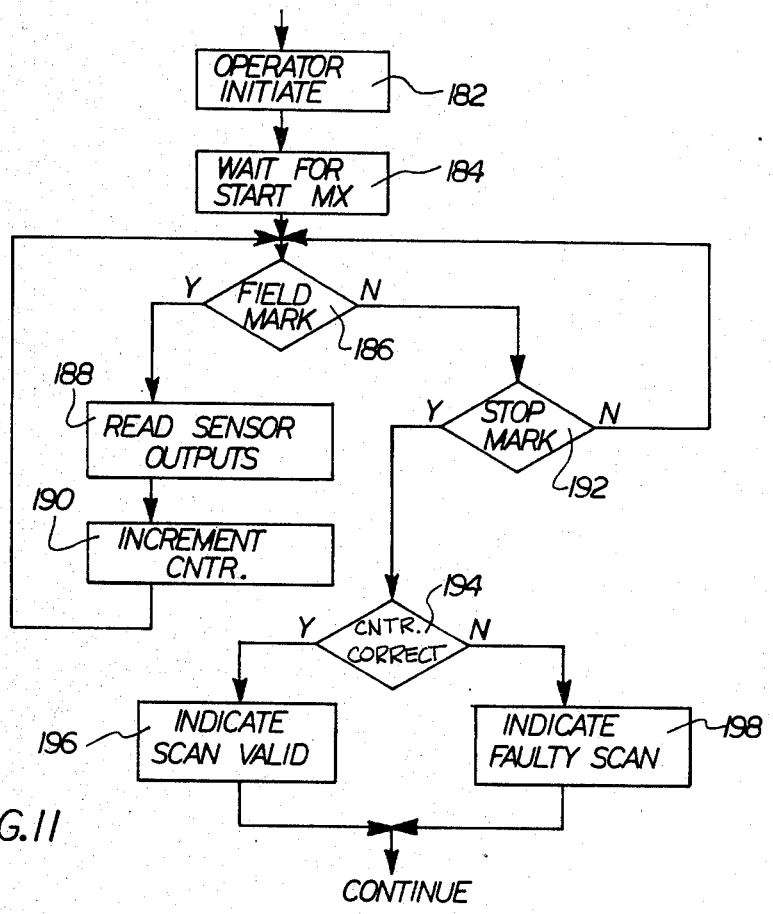
FIG. 11 is a flow chart illustrating the operations performed by the computer circuit of FIG. 10 in scanning the color bar.

FIG. 11 is a flow chart of the steps performed by the microcomputer 150 during the scanning of a color bar. As the scanner assembly 102 is moved rightward, the timing sensor 164 first detects the start timing mark 158. In step 184 the microcomputer waits for the start mark, then proceeds to step 186 to wait for the field timing marks. Each time the field timing mark sensor 162 detects one of the timing marks 156, it provides a pulse to the microcomputer 150. In response to each pulse (step 188) the microcomputer 150 reads the values of each of the analog signals provided by the sensors 144–147 through the analog input interface 148. The microcomputer determines which of the fields is being scanned by each optical assembly 118 and 120 of the scanner head 110 by keeping track of the number of the timing marks 156 which have passed the timing sensor 162 since the start mark 158 was detected. The analog values read by the microcomputer 150 from each field of the color bar are stored in corresponding locations in memory for later processing. The microcomputer then increments the timing mark counter (step 190) and returns to step 186.

Eventually, the scanner assembly 102 reaches the point at which the timing sensor 164 detects the stop mark 160, thereby indicating to the microcomputer 150 that the entire color bar has been scanned. When the microcomputer receives the pulse from timing mark sensor 164 (step 192) it checks the value of the timing mark counter (step 194). If the correct number of fields timing marks 156 were detected between the times of detection of the start timing mark 158 and the stop timing mark 160, the microcomputer 150 validates the scan (step 196) and advises the operator of this validation by an appropriate indication, e.g., the illumination or darkening of an indicator lamp, etc. If the total number of timing marks counted between the times of occurrence of the start and stop marks 158 and 160 is not correct, however, (due, for example, to inadvertent momentary movement of the scanning head 102 in a lefward direction) the scan will not be validated by the microcomputer. Instead, the microcomputer will indicate that an error has taken place (step 198). In this event the operator should repeat the scanning process, as outlined above.

The data thus acquired in this process is suitable for both register control and color control, as well as for diagnosing such press problems as picking-up paper and ink dissemination. Thus, total press control is achieved in a single, unified process of data acquisition and processing. The manner in which the acquired data is used for color control and diagnostics is irrelevant to the present invention and therefore will not be described herein.

Figure 12:
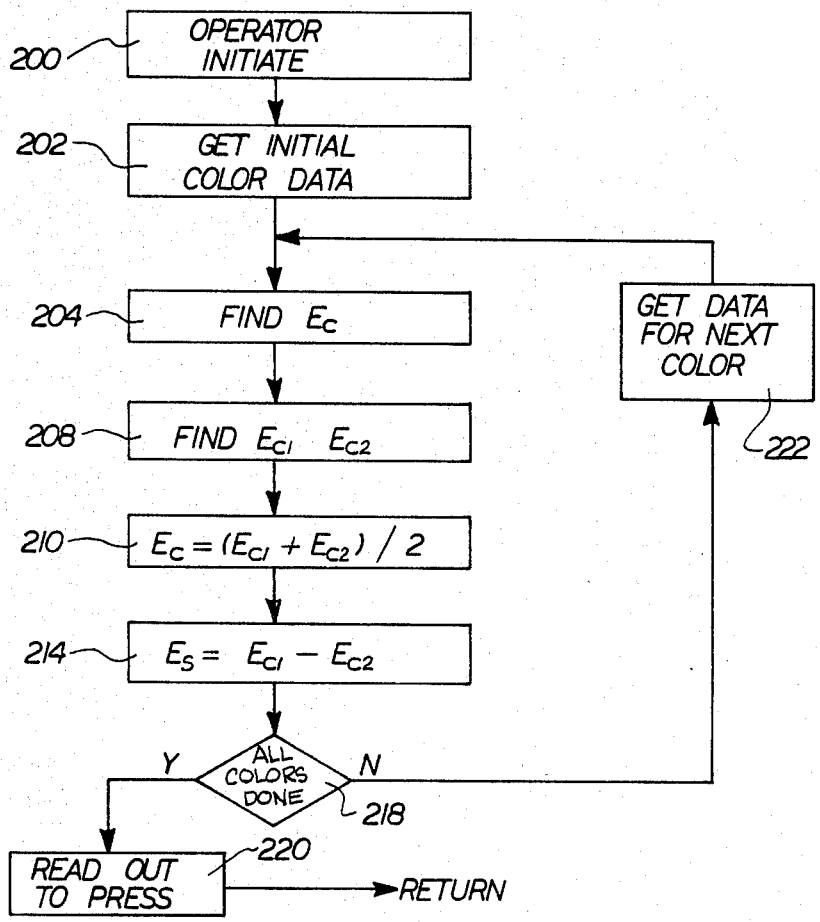
FIGS. 12 and 13 are flow charts illustrating the operations performed by the computer to correct register errors.

FIG. 12 is a flow chart illustrating generally the registration procedures performed by the microcomputer 150 upon the completion of scanning of the color bar in the manner described above. The microcomputer jumps into this procedure at step 200 when the operator initiates the procedure by depressing an appropriate switch associated with the switch array 155. In step 202 the microcomputer fetches the register indicia field data relating to the first color to be registered from memory. This data is the data obtained during the scanning procedure detailed above.

In step 204, the microcomputer determines lateral register error $E_l$ from the data fetched in step 202. (The manner in which this register error is determined will be described in greater detail hereinafter with reference to FIG. 13.) For example, if the color cyan is being registered, the register error is determined by processing the data obtained from scanning register band B5. This register error value will later be applied to the lateral register error control mechanism for correction of lateral registration. In step 208 the microcomputer determines the circumferential errors $E_{c1}$, $E_{c2}$ on the left and right sides of the color bar as viewed in FIGS. 7A and 7B. In step 210 circumferential error is determined by averaging the two terms $E_{c1}$ and $E_{c2}$. The averaging of $E_{c1}$ and $E_{c2}$ eliminates the influence of skew on the circumferential error determination.

Skew of the color image being registered is detected in step 214 by subtracting the circumferential register error terms $E_{c1}$ and $E_{c2}$. If the blanket cylinder is properly cocked, the circumferential errors on the left and right side of the color bar will be the same whereby the skew error value $E_s$ will be equal to zero. The extent to which this terms differs from zero corresponds to the extent of image skew.

Having thus determined circumferential register, lateral register, and skew error values for one color, the microcomputer proceeds on to conditional step 218. If error values for all three colors have now been determined, the microcomputer proceeds on to step 220. If, on the other hand, error values must yet be determined for one or more other colors, the microcomputer jumps instead to step 222, wherein data for the next color to be registered is fetched from memory. After step 222, the microcomputer repeats steps 204–214 in order to find updated register and skew error values for the new color. When all colors have been processed, the microcomputer proceeds on to step 220, wherein the updated register values are read out to the press. The various adjustment mechanisms associated therewith respond by adjusting the register and skew of the associated unit in accordance with the error signals. The updated register values are outputted on twelve output lines 221 through the analog or digital output interface 154. The nature of these signals (digital or analog, voltage and current values) will of course be dependent upon the requirements of the various adjustment mechanisms being controlled. The microcomputer also provides an upper/lower deck control signal indicating whether the upper or lower deck is to respond to the control signals being provided. The value of this control signal is dependent upon whether the color bar which was scanned originated from the top or bottom of the web.

After waiting an appropriate interval to allow the updated register and skew values to set into the press, the pressman takes another signature from the output of the press and scans the color bar with the scanning mechanism described above with respect to FIGS. 8 and 9, and then initiates microcomputer adjustment of the register of the press. This process continues until the registration of the press is acceptable to the pressman.

Figure 13:
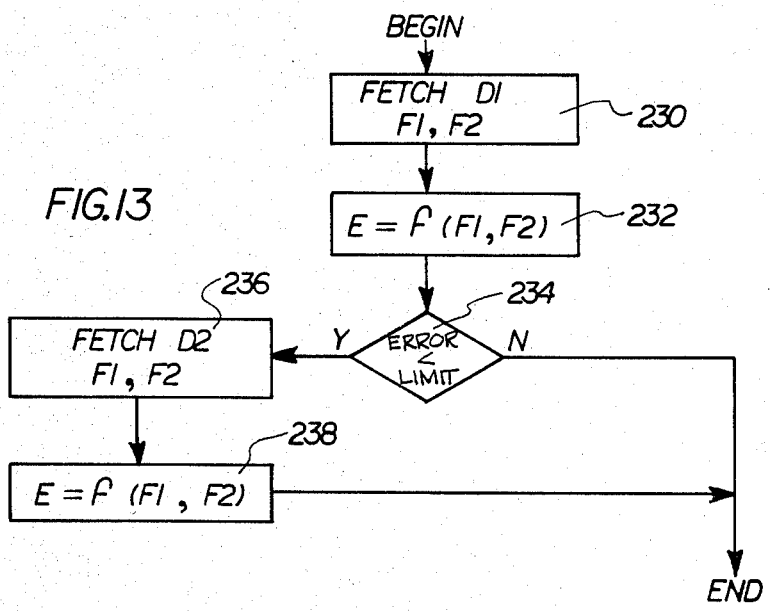

FIG. 13 illustrates in greater detail the operations performed by the microcomputer in determining register errors, whether circumferential or lateral. The steps illustrated in FIG. 13 are performed in each of steps 204 and 208. In step 230, the microcomputer fetches the "Y" readings from two fields F1 and F2 of the first digit of the variable being registered. Thus, if circumferential register is being adjusted, then data from the two fields F1 and F2 such as shown in FIG. 7 will be fetched from memory.

From the scanning procedure described previously with respect to FIG. 11, it is apparent that each of the fields of the color bar is viewed through each of four different filters 140–143 of FIG. 9. Consequently four different readings are available for each field of the color bar. In detecting misregister, the values of interest are those produced when viewing the fields through the filter which is the compliment of the color being registered. Thus, for example, if magenta is being registered, then the data fetched in step 230 will be that data which was acquired through a green filter, since green is the compliment of magenta. As viewed through this filter, both the magenta and the black image will appear black, whereby the percentage of nonprint areas in the two fields may be used to determine register error in the fashion described heretofore with respect to FIGS. 3 and 4.

In step 232 the microcomputer calculates register error as a function of the percentage of nonprint areas in the fields F1 and F2. The calculations performed by the microcomputer in determining this error have been described above with respect to equations (5) and (10) and will not be repeated for that reason. Before using equations (5) and (10) the measured Y values are corrected to remove an offset value $Y_o$ introduced by the measurement process.

The mathematical manipulations leading to equations (5) and (10) presume that the measured Y value will be zero for a register indicia field where the reference and comparison color lines are perfectly interlaced. Often, however, the measured Y value (which will be referred to as $Y_o$) will not be zero under these conditions. Worse, the extent to which the $Y_o$ value deviates from zero will not be fixed, instead varying with the type and density of the ink used, the extent to which the press is "picking up paper" and other factors.

To remove the resulting $Y_o$ offset it is presently preferred that the microcomputer determine a $Y_o$ value for each register band, and then subtract the $Y_o$ value thus determined from each measured Y value for that register band. When the Y values have been corrected in this fashion, equations (5) and (10) can be used as described previously.

The $Y_o$ value for each register band can be determined by several methods. The presently preferred method is to average the Y readings taken from the fields printed in the solid reference and comparison color inks. The resulting value should correspond to the $Y_o$ value, which is after all the Y value measured for a field which is printed half in the reference color and half in the comparison color.

To accomplish the $Y_o$ value determination the microcomputer first fetches two Y values from memory relating to an adjacent color band. The two Y values chosen are those measured for the fields which are printed in the reference and comparison colors, as viewed through a complementary filter. These two Y values are then averaged to get $Y_o$.

For example, the two Y values selected for register band B1 (where the reference color is cyan) are those from fields 1 (solid black) and 2 (solid cyan) of the color band, as measured through the red filter (since red is the complement of cyan). These two Y values are then averaged by adding them together and dividing their sum by two. The resulting value is $Y_o$ for register band B1.

The register error calculated through use of equations (5) and (10) is compared with a limit in step 234 to determine whether or not the error is small enough that the register error indicated by the second digit is valid. If the register error is in the range of plus or minus 3T/8 (T being the period of the lines in the second digit), the microcomputer proceeds on to step 236, wherein the data relating to fields F1 and F2 of the second digit is fetched for calculating a more refined register error indication. This procedure is essentially the same as that conducted in step 232, except that the period T of the lines is much smaller. Thus, the error in this case becomes the error calculated in step 238, rather than that calculated in step 232. After calculating the error in this fashion, the microcomputer returns to the main program (FIG. 12).

In the embodiment which has been described above, the registration is accomplished by a "man-in-the-loop" feedback arrangement, wherein a press operator is relied upon to obtain a copy of a signature from the press output and to then insert the signature into a device for scanning the color bar so that data relating to circumferential and lateral register and skew may be obtained therefrom. Alternatively, this operation may be performed in a completely automatic feedback loop. In such a system the devices for sensing the percentage of nonprint areas in the register indicia fields are located upon the press itself, whereby intervention by a press operator is not required.

Figure 14:
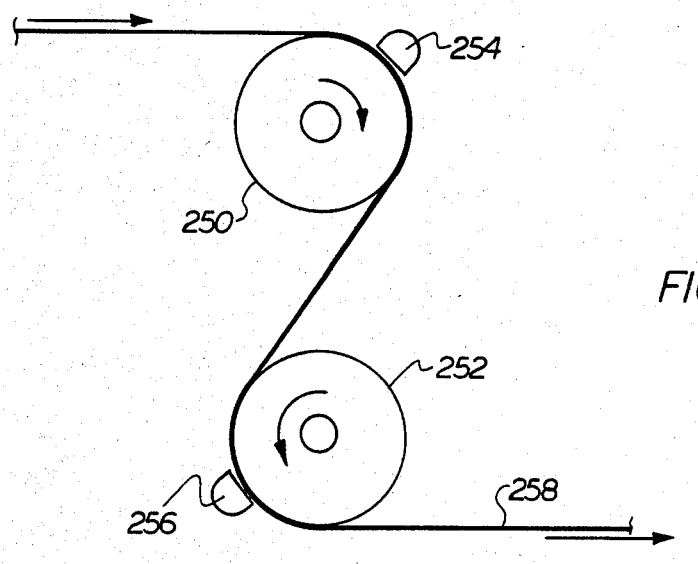
FIG. 14 is an elevation view of the chill rolls of the press, showing the placement of two strobe bars in a second embodiment of the invention.

FIG. 14 illustrates one embodiment wherein the sensing of the register indicia is performed in the vicinity of two chill rollers 250 and 252 located at the output 24 (FIG. 1) of the press. In this embodiment a first strobe bar 254 is located adjacent chill roll 250 and second strobe bar 256 is located adjacent chill roll 252. Since the web 258 is rounded around the chill rolls 250 and 252 in an S-wrap configuration, the upper surface of the web is exposed around chill roll 250, whereas the lower surface of the web is exposed around chill roll 252. The two strobe bars 254 and 256 therefore view different surfaces of the web and provide data for registering the upper and lower decks, respectively, of each printing unit.

The strobe bars 254 and 256 are longitudinal bars extending essentially the entire width of the web 258. Each scanning bar 254 includes four optical assemblies for each of the register bands, where each of the assemblies is positioned laterally across the web so that it is aligned with a corresponding one of the four fields included in the two digits of that register band. Since there are a total of nine register bands, each including four fields of register indicia, there need only be a total of 36 sensors associated with each of the scanning bars 254 and 256 in order to obtain register information. Preferably, however, other sensors will be included for obtaining color and diagnostic information from other fields of the color bar. The color used as the comparison color in the field of view of each of the sensors is known, so that the sensor need include only a light source and a single photosensitive sensor. The sensor includes a single filter corresponding to the compliment of the comparison color being viewed by that sensor.

Figure 15:
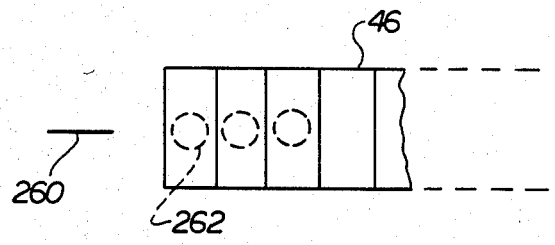
FIG. 15 is an illustration of a modified color bar for use with the FIG. 14 embodiment.

The color bars which are scanned by the strobe bars 254 and 256 are aligned under the color bars only for a brief moment as the web 258 travels around the chill rolls. The color bar may be modified slightly in order to simplify the "on the fly" data acquisition from the color bar. One possible altered color bar configuration is shown in FIG. 15. The principle distinguishing feature of this altered configuration is the inclusion of a timing mark 260 laterally adjacent the color bar 46. This laterally extending timing mark 260 is sensed by an indicia sensor mounted at the end of each strobe bar 254 and 256. The indicia sensor triggers the microcomputer 152 each time the timing mark 260 is sensed. The microcomputer responds by reading the outputs from the sensors disposed along the strobe bar. The microcomputer may be programmed to read all of the sensors each time a trigger pulse is received or, alternatively, to read the sensor sequentially upon sequential trigger pulses. At the time of sensing of this timing mark, the fields of view 262 of the sensors are in proper circumferential alignment with a corresponding field of the color bar 46. The color bar 46 preferably has expanded circumferential dimensions so that the fields of view 262 of the sensors will remain within its boundaries during the reading process, regardless of skew of the color bar relative to the strobe bar 254, 256, minor timing errors, etc. After the register data is acquired "on the fly", the remainder of the register operation is as described heretofore.

Although the invention has been described with respect to a preferred embodiment, it will be appreciated that various rearrangements and alterations of parts may be made without departing from the spirit and scope of the present invention, as defined in the appended claims.

What is claimed is:

1. A method of indicating misregister between two overlapped images, comprising the steps of:

forming a first plurality of spaced lines of equal width in a first indicia area occupying a known position relative to one of said two overlapped images, said lines being transversely spaced apart by an amount which is small relative to the lengths of said lines and is substantially the same as the width of said lines and being substantially straight and disposed substantially parallel to one another, forming a second plurality of spaced lines in a second indicia area occupying a known position relative to the other of said overlapped images, said second plurality of lines being spaced apart by an amount which is small relative to the lengths of said lines and being substantially straight and oriented substantially parallel to one another and to said first plurality of lines such that when said first and second areas overlap one another the extent to which said lines of said first and second areas overlap one another changes with displacement between said two indicia areas in a direction transverse to said lines, said known position relative to the other of said overlapped images being selected so that when said overlapping images are in register said first and second indicia areas overlap, wherein said step of forming said second plurality of lines comprises the step of forming said lines to have substantially the same width and spacing as said first plurality of straight lines and in a location relative to said other of said overlapped images such that when said overlapped images are in register said second plurality of lines is displaced relative to said first plurality of lines by a fraction of the thickness of said lines, whereby misregister of said overlapped images in a first direction causes said first and second plurality of lines to overlap to a greater extent and misregister in an opposite direction causes said first and second plurality of lines to overlap to a lesser extent, illuminating the area of overlap of said first and second indicia areas, detecting light returned from at least a significant portion of said first area of overlap and providing a first signal in accordance therewith, said signal having a value indicative of the amount of light returned from the entire said portion and thus representing the extent of overlap of said lines of said first and second indicia areas, and utilizing said signal value as a measure of misregister of said overlapping images.

2. Apparatus for detecting misregister of colors in a multicolor image wherein the measure of a distributed characteristic of a register indicia area is functionally dependent upon the extent of misregister of said colors in a predetermined direction, said register indicia area having two similar overlapping sets of parallel, straight lines, each set being formed in a different color, where in each set the spacing between the lines is comparable to the widths of the lines, comprising:

means for sensing the measure of said characteristic of said register indicia area over at least a significant portion of said area and providing a signal having a single value indicative of said measure over the entire said significant portion of said area, and means responsive to said signal for determining therefrom the extent of misregister of said colors in said predetermined direction, wherein said means for sensing comprises an optical detector for sensing light reflected from said area, said detector having a field of view which is broad enough that multiple ones of said lines of said overlapping sets of lines are within the field of view of said optical detector at one time, whereby the signal provided by said detector has a single value which is representative of the average reflectivity of a portion of said area including multiple lines.

3. Apparatus as set forth in claim 2 wherein said characteristic is the average reflectivity of said register indicia area, and wherein said means for sensing comprises means for sensing the reflectivity of at least a significant portion of said register indicia area.

4. Apparatus as set forth in claim 3, wherein said means for sensing the reflectivity of said register indicia area comprises means for illuminating said register indicia area, and means for sensing the amount of light reflected from at least a significant portion of said area and providing a signal having a value indicative of the amount of light reflected from the entire said portion, said signal value thus indicating the measure of said characteristic over the entire said significant portion of said register indicia area.

5. Apparatus as set forth in claim 2, wherein said means responsive to said signal indicative of said measure of said characteristic comprises a computer programmed to convert said signal value indicative of said measure into a misregister correction signal for application to a misregistration correction device.

6. Apparatus as set forth in claim 5, wherein said computer is programmed with a function correlating said measure with register error.

7. Apparatus as set forth in claim 2 wherein said multicolor image is formed on a planar printing medium, and wherein said apparatus further comprises means positionable over said printing medium such that said sensing means is aligned above said register indicia area.

8. Apparatus as set forth in claims 2, wherein said multicolor image is formed on a moving web and wherein said apparatus further comprises means for mounting said sensing means over said moving web such that said sensing means is aligned at the transverse location on said moving web at which said register indicia area is formed.

9. Apparatus as set forth in claim 8, and further wherein said determining means includes means responsive to a trigger signal for sampling said signal provided by said sensing means, and further comprising means for providing said trigger signal when said register indicia area is passing said sensing means during movement of said web.

10. Apparatus as set forth in claim 2, wherein said register indicia area is formed as part of a color bar and wherein said apparatus further includes means for scanning said color bar with said means for sensing.

11. Apparatus as set forth in claim 10, wherein said means for scanning said color bar comprises means for moving said means for sensing along said color bar so that different portions of said color bar are sequentially sensed by said sensing means, said signal provided by said sensing means sequentially assuming values representative of said sequentially sensed portions of said color bar.

12. Apparatus for determining the extent of misregister of colors in a multicolor image having a register indicia area wherein the average reflectivity of said area is substantially directly related to misregister of said colors in said predetermined direction, comprising:

means for illuminating said register indicia area;

means for sensing the intensity of light reflected from said area and for providing a signal having a single value which is representative of the total amount of light reflected from a substantial portion of said area, said signal value thus indicating the average reflectivity in said register indicia area, and means responsive to said signal for determining the extent of misregister in said predetermined direction in accordance with said signal value, wherein said register indicia area has two overlapping images formed therein in different colors, wherein two additional areas are provided, each having a solid image formed therein in a corresponding one of said different colors whereby the reflectivity of each said additional area is indicative of the color density of the corresponding color, wherein said means for illuminating and means for sensing respectively illuminate said areas and sense intensity of reflected light from each said additional area, said sensing means providing signals indicative of the intensity of light reflected from each said additional area, and wherein said means for determining comprises means for averaging the values of signals provided by said sensing means for each additional area, and for utilizing the resulting average value to correct the value of said signal provided by said sensing means for said register indicia area, whereby said determining means determines the extent of misregister in accordance with the values of the signals indicative of the intensity of reflected electromagnetic energy from said register indicia area and said additional areas.

13. The method of determining misregistration between two overlapped printed images, said method comprising the steps of:

printing a first registration indicator in a first area at a known position relative to a first of said overlapped printed images, said first registration indicator including a first plurality of substantially parallel straight lines of first predetermined width and transversely separated from one another by a first predetermined dimension comparable to said first predetermined width, printing a second registration indicator in a second area at a known position relative to a second of said two overlapped printed images, said second registration indicator including a second plurality of substantially parallel straight lines of second predetermined width and transversely separated from one another by a second predetermined dimension comparable to said second predetermined width, said second plurality of lines at least partially overlapping said first pluralitv of lines, detecting the extent of overlap of said first and second plurality of lines by determining the total amount of resultant printed or space area within a significant portion of the overlapping areas of said first and second areas, and utilizing said extent of overlap as a measure of misregistration of said two overlapping printed images, wherein said first registration indicator includes a third plurality of substantially parallel straight lines of predetermined width and transversely separated from one another by a third predetermined dimension, said second registration indicator including a fourth plurality of substantially parallel straight lines of predetermined width and transversely separated from one another by a fourth predetermined dimension, said fourth plurality of lines being substantially parallel to said third plurality of lines and at least partially overlapping said third plurality of lines, said fourth plurality of lines being transversely offset from said third plurality of lines by a predetermined dimension, and further including the additional step of detecting the extent of resultant space between said first and second overlapping registration lines and the resultant space between said third and fourth overlapping registration lines, and utilizing said extents as an indication of the direction of misregistration of said overlapping printed images.

14. A method of indicating misregister between two overlapped images, comprising the steps of:

forming a first plurality of spaced lines in a first indicia area occupying a known position relative to one of said two overlapped images, said lines being spaced apart by an amount which is small relative to the lengths of said lines and being substantially straight and disposed substantiallv parallel to one another, forming a second plurality of spaced lines in a second indicia area occupying a known position relative to the other of said overlapped images, said second plurality of lines being spaced apart by an amount which is small relative to the lengths of said lines and being substantially straight and oriented substantially parallel to one another and to said first plurality of lines such that when said first and second areas overlap one another the extent to which said lines of said first and second areas overlap one another changes with displacement between said two indicia areas in a direction transverse to said lines, said known position relative to the other of said overlapped images being selected so that when said overlapping images are in register said first and second indicia areas overlap, illuminating the area of overlap of said first and second indicia areas, detecting light returned from at least a significant portion of said first area of overlap and providing a first signal in accordance therewith, said signal having a value indicative of the amount of light returned from the entire said portion and thus representing the extent of overlap of said lines of said first and second indicia areas, and utilizing said signal value as a measure of misregister of said overlapping images, further comprising the steps of forming a third plurality of lines, similar to said first plurality of lines, in a third indicia area relative to said one of said overlapping images, forming a fourth plurality of lines, similar to said second plurality of lines, in a fourth indicia area relative to said other of said overlapping images, said positions of said third and fourth indicia area relative to the respective said images being selected such that said third and fourth pluralities of lines overlap one another to a different extent than said first and second pluralities of lines, illuminating the area of overlap of said third and fourth indicia areas, and detecting light returned from at least a significant portion of said area of overlap of said third and fourth indicia areas and providing a second signal in accordance therewith, said signal having a value representative of the amount of light returned from the entire said portion, and wherein said step of utilizing comprises the steps of utilizing said first and second signal values to determined the extent of misregister of said overlapping images.

15. A method as set forth in claim 14, wherein said step of utilizing comprises the steps of determining the ratio of the sum of said first and second signal values to the difference of said values, and determining the extent of misregister of said overlapping images from said ratio.

16. A method as set forth in claim 14, whrein one of said steps of forming said third and fourth pluralities of lines includes the step of forming said lines such that the position of said third plurality of lines is displaced relative to said fourth plurality of lines by one quarter the period of said lines from the relative position of said first and second pluralities.

* * * * *